US009009899B2

(12) United States Patent
Schnitzler et al.

(10) Patent No.: US 9,009,899 B2
(45) Date of Patent: Apr. 21, 2015

(54) ARRANGEMENT FOR SUPPORTING A BRACE, IN PARTICULAR A STAY CABLE, TRANSVERSELY TO THE LONGITUDINAL EXTENT THEREOF

(71) Applicant: Dywidag-Systems International GmbH, Munich (DE)

(72) Inventors: Lorenz Schnitzler, Poecking (DE); Werner Brand, Freising (DE); Andreas Maerzluft, Unterschleissheim (DE); Egbert Zimmermann, Rosenheim (DE)

(73) Assignee: Dywidag-Systems International GmbH, Munich (DE)

( * ) Notice: Subject to any disclaimer, the term of this patent is extended or adjusted under 35 U.S.C. 154(b) by 0 days.

(21) Appl. No.: 14/147,975

(22) Filed: Jan. 6, 2014

(65) Prior Publication Data

US 2014/0115984 A1 May 1, 2014

Related U.S. Application Data

(63) Continuation of application No. PCT/EP2012/002612, filed on Jun. 21, 2012.

(30) Foreign Application Priority Data

Jul. 4, 2011 (DE) ..... 10 2011 106 431

(51) Int. Cl.
*E01D 11/00* (2006.01)
*E04C 5/12* (2006.01)
*E01D 19/14* (2006.01)

(52) U.S. Cl.
CPC ..... *E04C 5/122* (2013.01); *E01D 19/14* (2013.01)

(58) Field of Classification Search
USPC ..... 14/18, 19, 20, 21, 22, 23; 52/223.1
See application file for complete search history.

(56) References Cited

U.S. PATENT DOCUMENTS

| | | | | |
|---|---|---|---|---|
| 4,648,146 | A * | 3/1987 | Nutzel et al. | 14/21 |
| 4,648,147 | A | 3/1987 | Zimmermann et al. | |
| 7,124,460 | B2 * | 10/2006 | Lecinq et al. | 14/22 |
| 7,200,886 | B2 * | 4/2007 | Nuetzel et al. | 14/22 |
| 7,299,516 | B2 * | 11/2007 | Nuetzel et al. | 14/22 |
| 7,943,217 | B2 * | 5/2011 | Baumgartner | 428/34.5 |

(Continued)

FOREIGN PATENT DOCUMENTS

| | | |
|---|---|---|
| DE | 34 34 620 A1 | 4/1986 |
| DE | 295 04 739 U1 | 5/1995 |

(Continued)

*Primary Examiner* — Gary Hartmann
(74) *Attorney, Agent, or Firm* — Muncy, Geissler, Olds & Lowe, P.C.

(57) ABSTRACT

An arrangement for supporting a brace transversely to the longitudinal extent thereof in the vicinity of the anchorage of a structure having a cavity pipe, an adapter ring, a tubular or annular supporting element which has a second axially loadable support surface, which is arranged concentrically in relation to the second axially loadable bearing surface of the adapter ring and of which the opening, which encircles a third longitudinal axis, forms a supporting surface for the brace by way of its inner circumference, wherein the opening has an amount of eccentricity E2 in relation to the second axially loadable support surface of the supporting element, and having a fastenor which clamps the cavity pipe, the adapter ring and the supporting element together axially in position relative to one another.

11 Claims, 6 Drawing Sheets

(56) References Cited

U.S. PATENT DOCUMENTS 8,650,691 B2 * 2/2014 Collin Delavaud et al. ..... 14/22
8,869,476 B2 * 10/2014 Delavaud et al. ..... 52/223.13

FOREIGN PATENT DOCUMENTS

DE 295 17 250 U1 12/1995
DE 200 14 322 U1 1/2002

* cited by examiner

ARRANGEMENT FOR SUPPORTING A BRACE, IN PARTICULAR A STAY CABLE, TRANSVERSELY TO THE LONGITUDINAL EXTENT THEREOF

This nonprovisional application is a continuation of International Application No. PCT/EP2012/002612, which was filed on Jun. 21, 2012, and which claims priority to German Patent Application No. DE 10 2011 106 431.5, which was filed in Germany on Jul. 4, 2011, and which are both herein incorporated by reference.

BACKGROUND OF THE INVENTION

1. Field of the Invention

The invention relates to an arrangement for supporting a tension member, in particular a stay cable or a prestressing member, transversely with respect to the longitudinal extent thereof in a vicinity of the anchorage of a.

2. Description of the Background Art

Tension members of this type are known primarily as stay cables or external prestressing members of bridge structures, where they have a key function in the accommodation and transfer of loads that are present. For this purpose the tension members, composed of steel rods, steel wires, or steel strands, are tensioned between two components of a structure, the ends of each tension member being guided through the components within a channel and anchored at their rear side. The tension members extend freely in the free area between the anchorings.

Due to dynamic loads such as wind loads or traffic loads, for example, as well as temperature-related deformations of the structure, movements of the tension member in the operating state, in particular also in the transverse direction, are unavoidable. While such movements in the free area are acceptable within limits, they adversely affect the fatigue strength of the tension member in the anchoring area. This is counteracted by intercepting the movements in the transverse direction.

To this end, a tension member which extends in the anchoring area within a pretensioning channel which is formed by a cavity pipe is known from DE 295 04 739 U1. For concentrically fixing the tension member in the pretensioning channel, the tension member is enclosed by a ring tensioning element which on the one hand bundles the individual strands of the tension member before they are spread toward the anchoring, and on the other hand with its outer periphery contacts the inner side of the cavity pipe. In this way, movements of the tension member transverse to its longitudinal extent are limited to the area outside the pretensioning channel, thus increasing the fatigue strength of the tension member.

Due to manufacturing- and installation-related tolerances or the slack in stay cables, it is often the case that the actual longitudinal axis of the tension member differs from the target axis. To take these tolerances into account, it is necessary to fix the tension member eccentrically, not concentrically, in the pretensioning channel. This problem is addressed in the invention described in DE 34 34 620 A1, which corresponds to U.S. Pat. No. 4,648,147, in which a sufficiently large annular chamber which expands the pretensioning channel within the structure via a longitudinal section provides space for the eccentric accommodation of the tension member. After the annular chamber is sealed off, it is pressed with a setting or loose, free-flowing material, thus fixing the eccentric position of the tension member within the pretensioning channel. In many cases this approach has proven satisfactory in practice.

A similar procedure is disclosed in DE 295 17 250 U1, according to which an annular closed pad is arranged around the tension member, forming a closed cavity, so that without further sealing operations, pressing may be carried out using a setting material while at the same time fixing the tension member.

To avoid the expenditure of time and effort associated with the pressing process, it is already known from DE 200 14 322 U1 to situate two circular rings, each having an eccentric opening, inside one another in such a way that they may be rotated relative to one another in the shared circumferential joint. The inner circular ring encloses the tension member, while the outer periphery of the outer circular ring is supported on the cavity pipe. The opening in the inner ring may be adapted to the eccentricity of the tension member by mutually rotating the rings.

SUMMARY OF THE INVENTION

It is therefore an object of the invention to provide a support of a tension member in the vicinity of the anchorage, transversely with respect to the longitudinal extent of the tension member.

The basic concept of the invention lies in providing an eccentric support of the tension member by the interaction of multiple mechanical components arranged axially in succession, wherein by providing bearing and support surfaces which extend eccentrically with respect to one another, partial eccentricities $E_1$ and $E_2$ result at the components which provide the given eccentricity in a predetermined position relative to one another by suitable overlapping in the course of assembling the individual components. The force-fit connection between the individual components is established via the axially loadable bearing and support surfaces, which are clamped together by means of axial clamping elements.

A first advantage of the invention results from the design which develops in the axial direction, i.e., in a direction in which tension members have sufficient free space in the normal case. The arrangement according to the invention may be kept narrow in the radial direction, which is advantageous not only with regard to appearance, but also with regard to the limited space in the vicinity of the anchorage.

Due to an axial connection of the arrangement according to the invention to the cavity pipe, the site of installation, in contrast to the known approaches, is outside the cavity pipe, and is therefore easily accessible from the outside. This simplifies not only assembly and disassembly of an arrangement according to the invention, but also its maintenance and repairs, if necessary.

In the event that the eccentricity E of the tension member changes over time due to deformation characteristics of the structure, the arrangement according to the invention, due to its capability for disassembly, easily allows subsequent adaptation to the altered geometry.

Another advantage of the invention is that constructional measures on the structure, for example providing an annular chamber in the cavity pipe, are not necessary. This is advantageous first of all from an economic standpoint, since a corresponding level of effort is not required. At the same time, however, the arrangement according to the invention opens the possibility for retrofitting or modifying existing structures without a great additional level of design effort for the structure itself.

Since an arrangement according to the invention is produced merely by assembling a few mechanical components, the necessary outlay of materials and time is very small, which further increases the cost-effectiveness of the invention.

In an embodiment of the invention, the two partial eccentricities $E_1$ and $E_2$ are equal, which results in the possibility of also adjusting the arrangement according to the invention to a tension member which extends centrally in the cavity pipe. For an eccentricity E that is present, which is larger than the sum of the two equal partial eccentricities $E_1$ and $E_2$, it is also conceivable that, by using a specialized adapter ring or supporting element, one of the two partial eccentricities $E_1$ or $E_2$ may be larger than the other.

One embodiment of the invention has also proven advantageous in which, in addition to the axially loadable bearing or support surfaces, radially loadable bearing surfaces are provided. The radially loadable bearing surfaces primarily take over the function of guiding and centering surfaces which simplify the axial joining of the individual components as well as their rotation about the longitudinal axis.

The axially loadable bearing or support surfaces may be composed of multiple partial surfaces which are stepped in the axial direction. The axial offset of the partial surfaces may advantageously be utilized for forming the radially loadable bearing surfaces. It is thus possible for the axial pressure forces in the contact joint to be transferred via a relatively large assembled bearing or support surface, which contributes to the overall stability of the connection.

According to an embodiment of the invention, the axially and/or radially loadable bearing or support surfaces may be equipped with anti-slip protection. This may be achieved by a suitable surface roughness or by coating with slip-resistant materials such as zinc silicate or the like. As the result of equipping with anti-slip protection, the force-fit connection between the individual components, and thus positional stability thereof, is enhanced.

The components of an arrangement according to the invention are advantageously clamped together by means of a clamping ring and clamping bolts. As the result of a relative position of the clamping bolts radially outside the axially loadable bearing or support surfaces, a stepless setting of the partial eccentricities $E_1$ and $E_2$, and thus a highly precise adaptation to a given eccentricity E, is ensured.

To avoid bending stresses in the clamping ring and/or the clamping bolts, another advantageous embodiment of the invention has a spacer ring between the ring flange of the cavity pipe and the adapter ring. To simplify assembly, the spacer ring may be welded to the ring flange or adapter ring.

In particular for subsequent installation of the arrangement according to the invention on a tension member, it has proven advantageous for the adapter ring and/or the supporting element and/or the clamping ring to have a two-part design. The two halves may thus be arranged around the tension member and held together without the tension member having to be removed for the assembly or disassembly.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
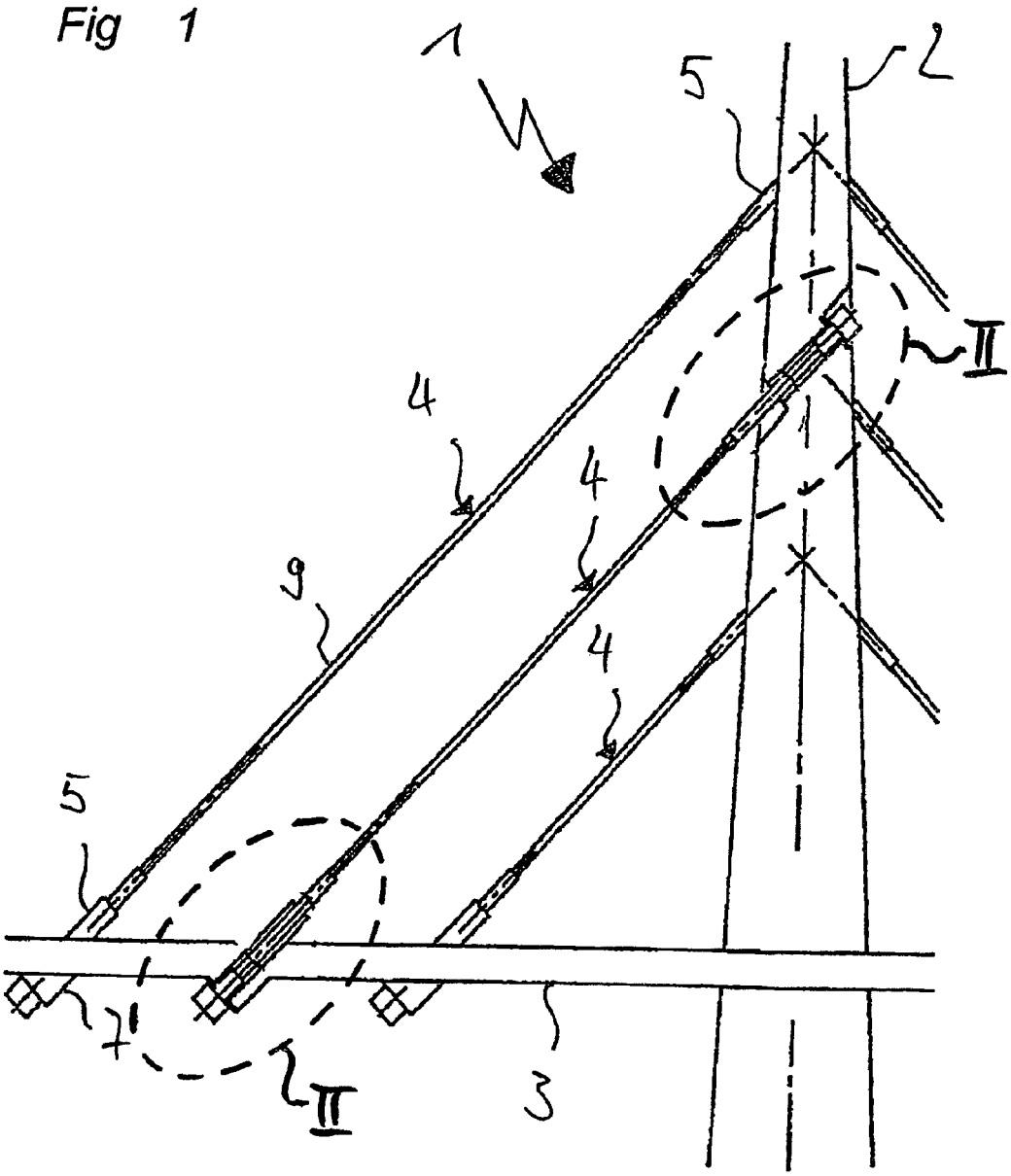
FIG. 1 shows a partial view of a stayed-cable bridge having an arrangement according to the invention.

FIG. 1 shows a portion of a stayed-cable bridge 1 having a pylon 2 made of reinforced concrete, on which a bridge girder 3 is suspended by means of stay cables 4. The anchoring areas for the stay cables 4 on the pylon 2 and the bridge girder 3 are formed by a pretensioning channel which is composed essentially of a steel cavity pipe 5 which is guided through the pylon 2 and the bridge girder 3 and which has been embedded in concrete in the course of production of the pretensioning channel. The pretensioning channel, i.e., the cavity pipe 5, is used for accommodating a stay cable 4 in each case.

Figure 2:
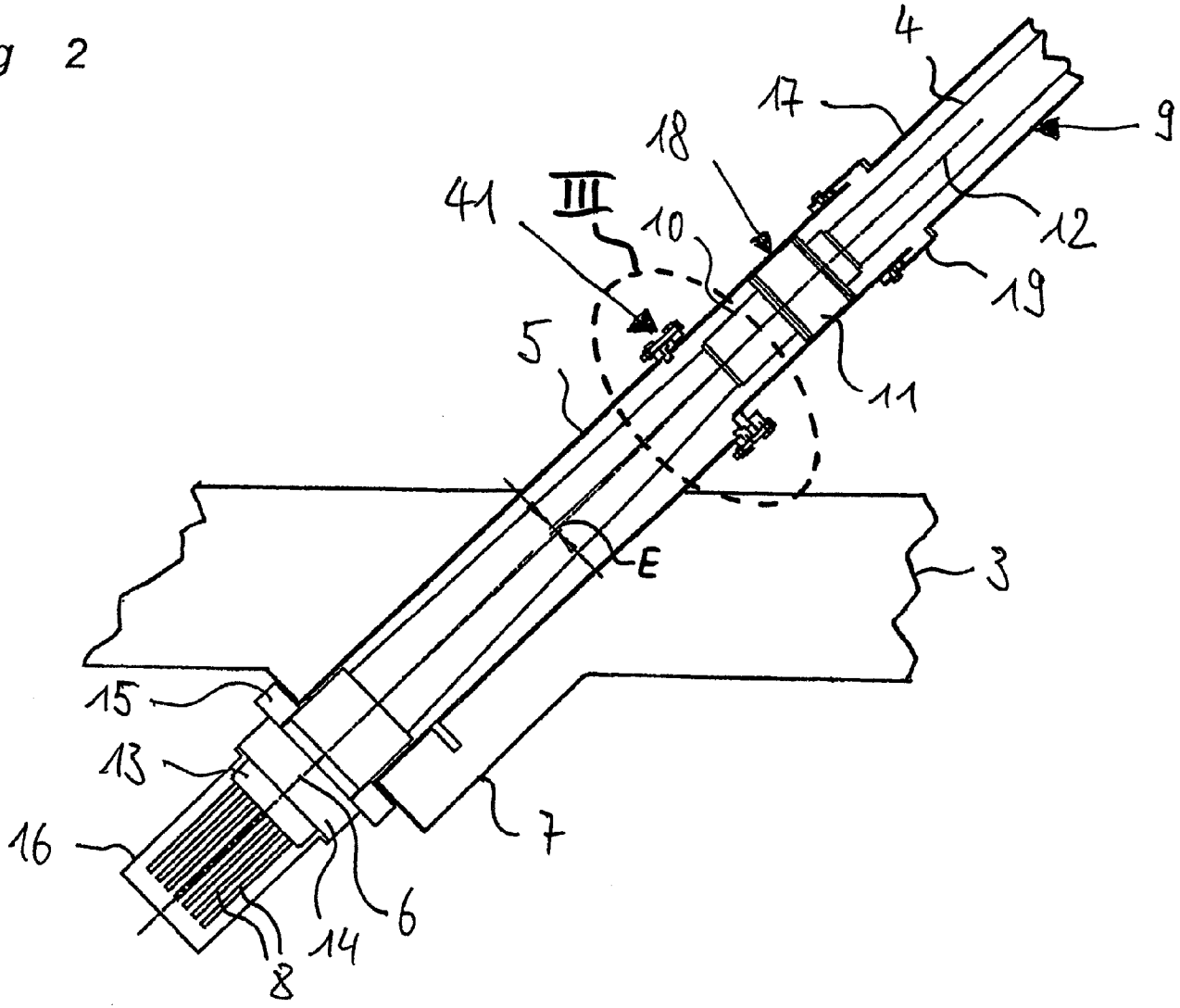
FIG. 2 shows a longitudinal section of the area denoted by reference numeral II in FIG. 1, FIG. 3, 4 each show an oblique view of the area, denoted by reference numeral III in FIG. 2, of an arrangement according to the invention in an exploded illustration.
Figure 3:
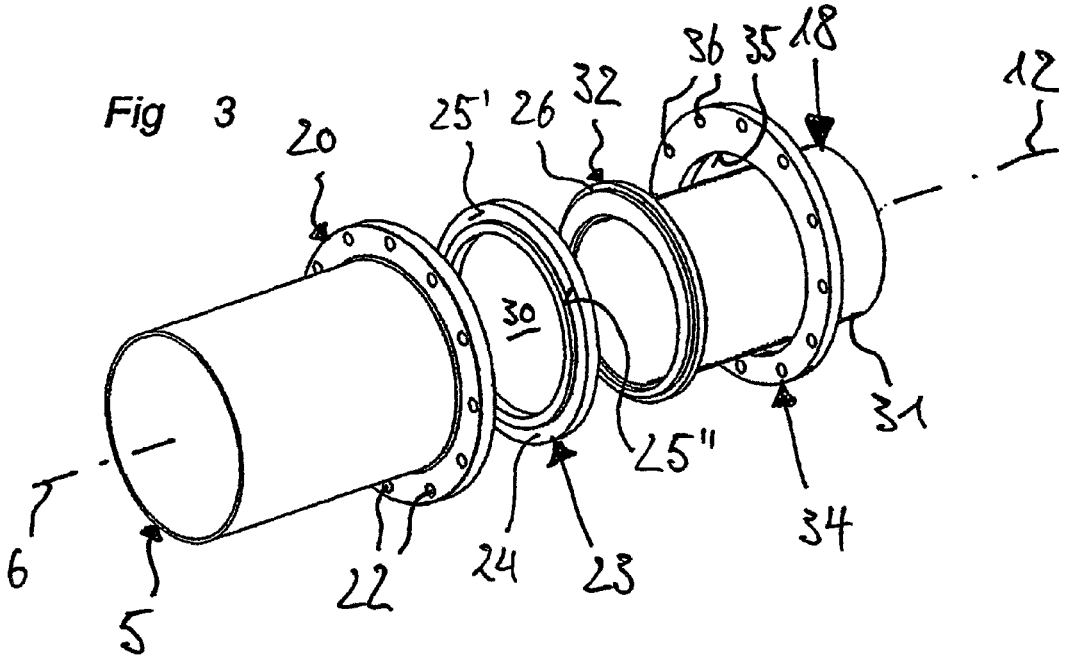
Figure 4:
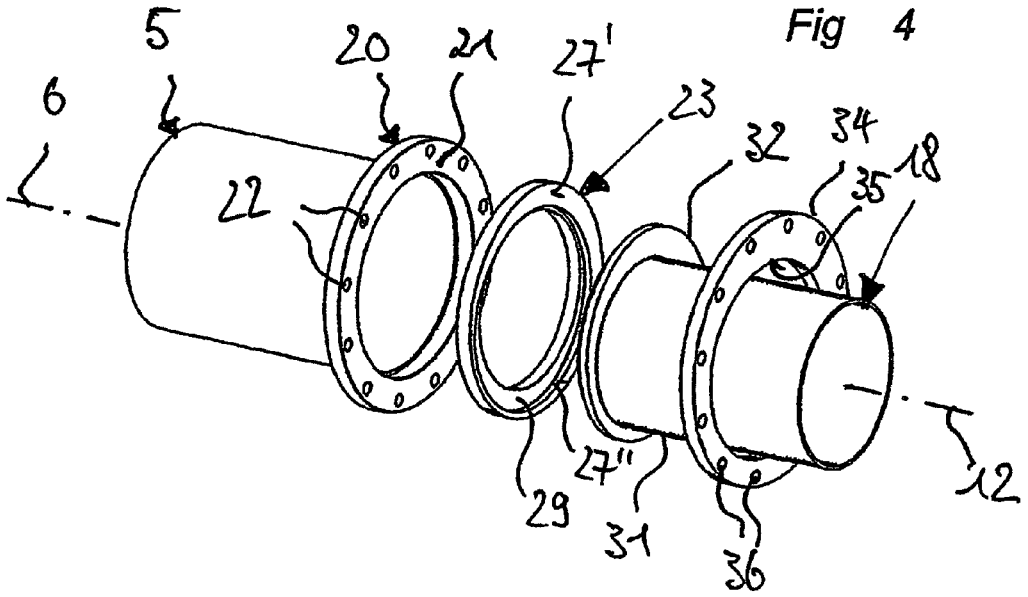

FIG. 2 depicts the lower anchoring area denoted by reference numeral II in FIG. 1, in enlarged scale. A cavity pipe 5 is shown which extends coaxially along a first longitudinal axis 6 and which passes through the bridge girder 3 and ends at the underside of the bridge girder, flush with an abutment pedestal 7 present there. The cavity pipe 5 forms a projection at the top side of the bridge girder 3. The anchoring area in the region of the pylon 2 has an essentially corresponding design, taking into account necessary modifications for adapting to the conditions at that location.

The tension member 4, which in the present example is formed by a bundle of individual elements 8, such as steel wire strands, situated within a protective pipe 9 extends within the cavity pipe 5. The annular gap between the protective pipe 9 and the individual elements 8 may be filled with a setting corrosion protection compound. The longitudinal axis of the tension member is denoted by reference numeral 12.

In the free area of the tension member 4 the individual elements 8 extend axially parallel at a close radial distance from one another. To provide sufficient space for the anchoring of the individual elements 8, the individual elements 8 in the anchoring area are spread within the cavity pipe 5 in the direction of the anchoring. For accommodating the ring tension forces which arise in the transition area due to the spreading, the individual elements 8 are enclosed in a cuff-like manner by a ring tensioning element 10, which in turn has an elastomeric bearing 11 on its outer periphery.

The individual elements 8 are secured in an anchor block 13 by means of wedges, the anchor block engaging with a ring nut 14 via a male thread. The ring nut 14 is supported on a support plate 15, which in turn lies against the abutment pedestal 7 and introduces the tensile forces from the tension member 4 into the structure 1. A cap 16 which is tightly connected to the ring nut 14 and is filled with a corrosion protection compound encloses the free ends of the individual elements 8.

In the free area the tension member 4 is enclosed by HDPE piping 17 which ends at an axial distance in front of the cavity pipe 5.

Due to manufacturing- and installation-related tolerances as well as load-related deformations of the structure, in the anchoring area the longitudinal axis 6 of the cavity pipe 5 and the longitudinal axis 12 of the tension member 4 frequently do not coincide. As a result, the tension member 4 does not adjoin the cavity pipe 5 centrally, and instead has an eccentricity E with respect to the longitudinal axis 6 at that location.

To minimize the negative effects, described at the outset, of transverse movements of the tension member 4 in the immediate anchoring area to the greatest extent possible, in the area of the ring tensioning element 10 the tension member 4 is secured against movements transverse to its longitudinal axis 12 by means of a support. A tubular supporting element 18 which at one end adjoins a bushing-like enlargement 19 of the piping 17 and at its opposite end is rigidly connected to the cavity pipe 5 via the flange connection according to the invention is used for this purpose. It is thus possible for the tension member 4 together with the elastomeric bearings 11 to lie against the inner periphery of the supporting element 18 and thus be held in position. During its installation, the supporting element 18 is already adjusted to the existing eccentricity E of the longitudinal axis 12 with respect to the longitudinal axis 6. The structural design necessary for this purpose is explained in greater detail below with reference to FIGS. 3 through 7.

FIGS. 3 through 5 and 7 each show the arrangement according to the invention in an exploded illustration. The end of the cavity pipe 5 together with the individual components of the supporting element 18 according to the invention which is to be connected to the cavity pipe 5 are apparent. To this end, a ring flange 20 which encircles the outer periphery of the cavity pipe 5 forms the termination of the cavity pipe 5. The ring flange 20 at its side facing the supporting element 18 and perpendicular to the longitudinal axis 6 forms a first axially loadable bearing surface 21 which is encircled by a number of axial through holes 22 which are situated on the same circumference and at equal circumferential distances. FIG. 6, view A-A shows an axial view of the ring flange 20.

An adapter ring 23 which adjoins in the axial direction and which encloses a central opening 30 cooperates with the ring flange 20. The first side of the adapter ring 23, facing the ring flange 20, is illustrated in FIG. 6, view B-B, and the opposite second side is illustrated in view C-C. FIGS. 3 through 6 and in particular FIG. 7 clearly show that along the outer periphery, the first side of the adapter ring 23 has an edge recess 24 which concentrically encircles the longitudinal axis 6 and results in a shoulder. A first stepped axially loadable support surface 25' and a radially loadable support surface 25" (FIG. 7) are formed in this way. During assembly of the arrangement according to the invention, the adapter ring 23 at the support surface 25" may be inserted in a positive-fit manner into the end of the cavity pipe 5 until the support surface 25' lies against the ring flange 20 of the cavity pipe 5. At this point in the assembly, the adapter ring 23 may still be arbitrarily rotated about the longitudinal axis 6 for setting a predefined first partial eccentricity $E_1$.

Figure 7:
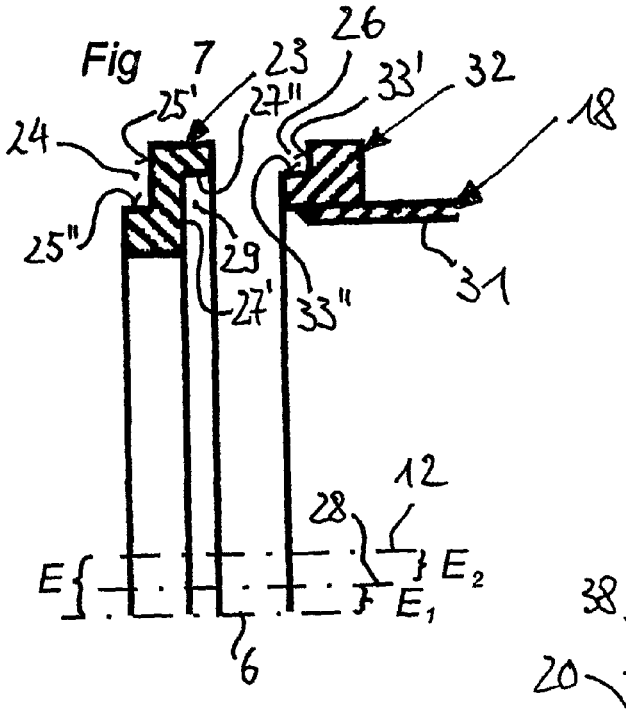
FIG. 7 shows a partial longitudinal section of the connecting area of the supporting element and the adapter ring, in larger scale.

The specific configuration of the second side of the adapter ring 23 is apparent from FIGS. 3 through 6 and in particular FIG. 7. At this location a step-shaped edge recess 29 which encircles concentrically with respect to a second axis 28 is present along the inner periphery of the opening 30, the axis 28 of the edge recess extending axially parallel to the axis 6 with a first partial eccentricity $E_1$. As a result of the edge recess 29, a second stepped axially loadable bearing surface 27' and a second radially loadable support surface 27" are formed (FIG. 7). The two edge recesses 24 and 29 each have a rectangular cross section, the radial cross-sectional dimensions of the edge recess 29 constantly changing due to the partial eccentricity $E_1$. The radially loadable bearing surface 25" and support surface 27" may also have a slightly conical shape in order to simplify the axial connection of the adapter ring 23 to the cavity pipe 5, and of the supporting element 18 to the adapter ring 23.

The edge recess 29 in the adapter ring 23 is used for the axial connection of a tubular supporting element 18 which is composed of a tubular section 31 whose inner periphery is intended for supporting the tension member 4, and an eccentric flange 32 which is fixedly connected to the end of the tubular section 31 facing the adapter ring 23. In the process, the longitudinal axis of the tubular section 31 coincides with the axis 12 of the tension member 4.

The eccentric flange 32 has a circumferential outer edge recess 26 along its outer periphery which, similarly as for the adapter ring 23, forms a second axially loadable support surface 33' and a radially loadable support surface 33". The edge recess 26 extends concentrically with respect to the edge recess 29 in the adapter ring 23, and eccentrically with respect to the opening in the tubular section 31 and with respect to the axis 12, resulting in a second partial eccentricity $E_2$.

The second axially loadable support surface 33' of the eccentric flange 32 has a design that is complementary to the second axially loadable bearing surface 27' of the adapter ring 23. The direction of the partial eccentricity $E_2$ may be set by rotating the supporting element 30 relative to the adapter ring 23 about the axis 28 during assembly of an arrangement according to the invention.

A clamping ring 34 is used for fixing the adapter ring 23 and the supporting element 18 in a predetermined position relative to the cavity pipe 5. The clamping ring 34 has an opening 35 whose diameter is smaller than the outer periphery of the eccentric flange 32, thus ensuring axial contact of the clamping ring 34 on the eccentric flange 32 in any position. The opening 35 may extend centrically as well as eccentrically with respect to the outer periphery of the clamping ring 34.

Figure 5:
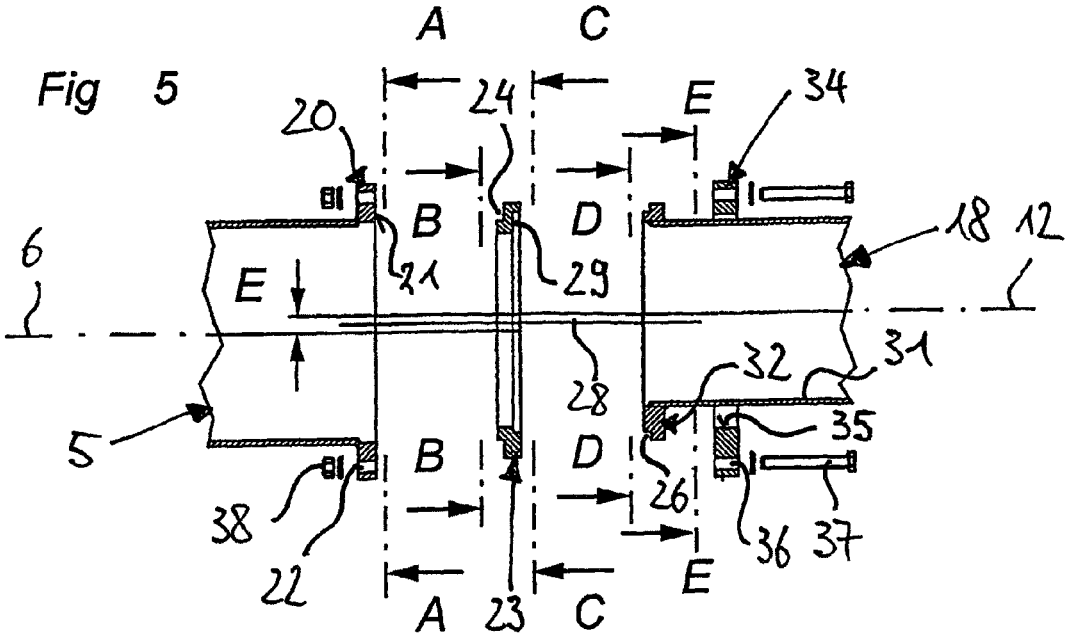
FIG. 5 shows a longitudinal section of the arrangement illustrated in FIGS. 3 and 4, FIGS. 6*a-e* show views A-A through E-E as provided in FIG. 5.
Figure 6A:
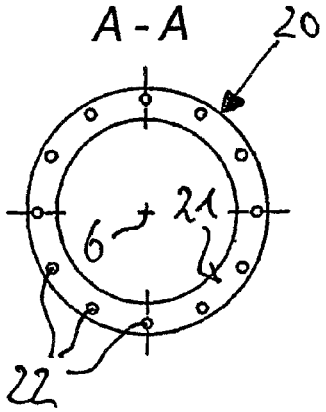
Figure 6B:
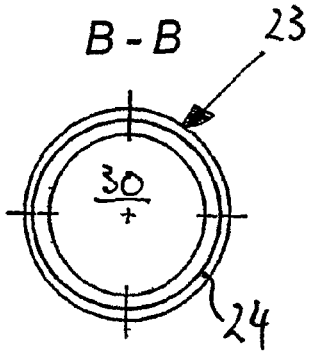
Figure 6C:
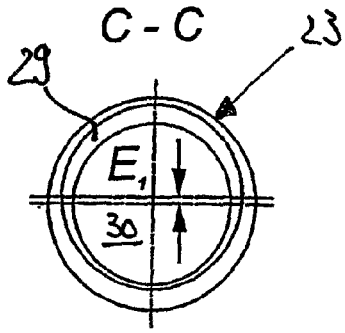
Figure 6D:
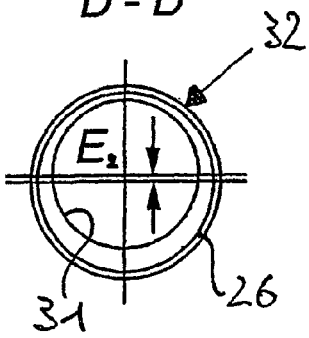
Figure 6E:
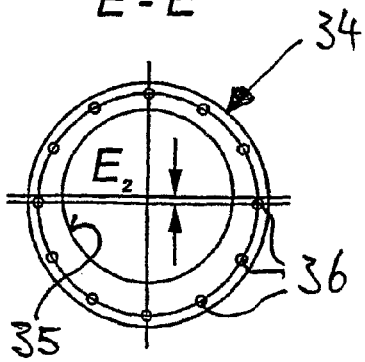
Figure 8:
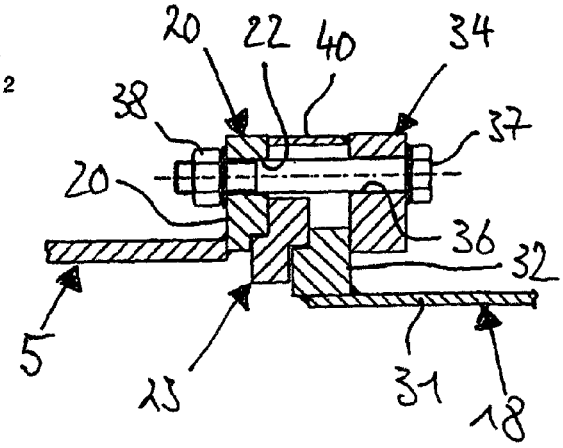
FIG. 8 shows a partial longitudinal section of one refinement of the arrangement according to the invention.

Axial through holes 36 are situated in the clamping ring 34, and have a hole pattern that corresponds to that of the ring flange 20, so that the clamping ring 34 may be clamped against the ring flange 20 by means of the axial clamping bolts 37 and associated nuts 38, with clamping of the adapter ring 23 and eccentric flange 32 (FIGS. 5 and 8).

The installation of an arrangement according to the invention is explained in greater detail below, with consideration of a possible deviation of the longitudinal axis 12 of a tension member 4 from the longitudinal axis 6 of the anchoring.

After the tension member 4 is installed, the eccentricity E of the tension member 4 with respect to the longitudinal axis 6 of the cavity pipe 5 is measured. Based on the eccentricity E that is present, the relative target position of the adapter ring 23 with respect to the cavity pipe 5 and the relative target position of the supporting element 18 with respect to the adapter ring 23 may be determined. A single degree of freedom for achieving the target position is the individual rotation of the adapter ring 23 and of the supporting element 18 about their longitudinal axes, so that in each case the radial direction of the partial eccentricities $E_1$ and $E_2$ may be set. Vector addition of the partial eccentricities $E_1$ and $E_2$ results in the magnitude and the direction of the overall eccentricity E. With regard to the eccentricity E that is present, and taking into account the previously determined directions of the partial eccentricities $E_1$ and $E_2$ of the tension member 4 in the axial direction, the adapter ring 23 and the supporting element 18 are thus placed on the end of the cavity pipe 5, and by means of the clamping ring 34, the clamping bolt 37, and nuts 38 are clamped against the ring flange 20 and thus fixed in the required position relative to one another. This state is shown in a sectional view in FIG. 8.

Figure 10A:
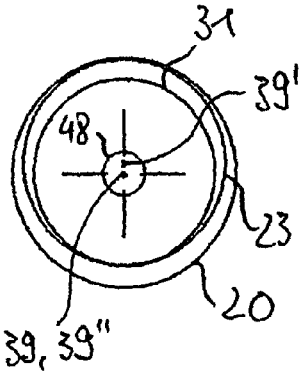
FIGS. 10*a-c* show examples of centric and eccentric support of a stay cable.
Figure 10B:
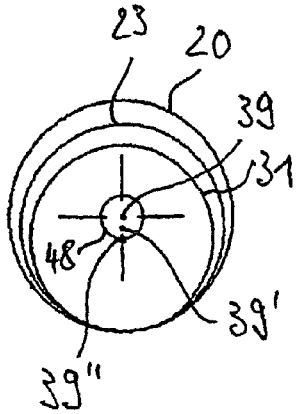
Figure 10C:
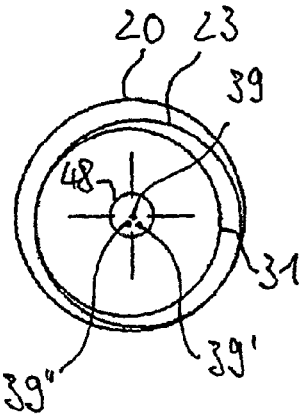

FIGS. 10*a* through 10*c* show examples of three possible cases of the eccentricity E which may occur during installation of a tension member 4. FIG. 10*a* shows the central position of the tension member 4 within the cavity pipe 5, FIG. 10*b* shows a relative position of the tension member 4 with respect to the cavity pipe 5 in which the maximum compensable eccentricity E is achieved, and FIG. 10*c* shows the most frequently occurring normal case in which the eccentricity E of the tension member 4 is less than the maximum compensable eccentricity E. Point 39 denotes the longitudinal axis 6 of the cavity pipe 5, point 39' denotes the position of the axis 28 due to the partial eccentricity $E_1$ after setting the adapter ring 23, and point 39" denotes the position of the longitudinal axis 12 of the tension member 4 after setting the eccentricity $E_2$ by rotating the supporting element 18 and overlapping the two eccentricities $E_1$ and $E_2$.

In the case of the central course of the longitudinal axis 12 of the tension member within the cavity pipe 5 (FIG. 10*a*), the adapter ring 23 and the supporting element 18 are joined together in such a way that the partial eccentricities $E_1$ and $E_2$ act in opposite directions. If the partial eccentricities $E_1$ and $E_2$ are equal, they cancel each other out, and the magnitude of the overall eccentricity E is zero.

The maximum overall eccentricity E (FIG. 10*b*) is achieved when the partial eccentricity $E_1$ of the adapter ring 23 and the partial eccentricity $E_2$ of the supporting element 18 point in the same direction, and are thus additive.

The areas between a central position of the longitudinal axis 12 of the tension member in the cavity pipe 5 and a maximum compensable eccentric position of the longitudinal axis 12 of the tension member are denoted by the circular line 48, and may be covered by a suitable overlapping of the two partial eccentricities $E_1$ and $E_2$, as illustrated in FIG. 10*c*, for example. In FIG. 10*c*, the direction of the partial eccentricity $E_1$ is initially set by appropriately rotating the adapter ring 23 about its longitudinal axis, obliquely and downwardly to the right (135° from the vertical). In the course of attaching the supporting element 18, whose partial eccentricity $E_2$ points to the left (270° from the vertical), the direction and the magnitude of the desired overall eccentricity E result.

FIGS. 8 and 9 show modifications of the invention described with respect to FIGS. 1 through 7. FIG. 8 shows a partial longitudinal section of the connecting area of the adapter ring 23 and the supporting element 30 on the cavity pipe 5. This embodiment essentially corresponds to that described in FIGS. 1 through 7, so that the description for these figures applies and the same reference numerals are used.

In addition, the embodiment illustrated in FIG. 8 has a support ring 40 which bridges the axial distance between the ring flange 20 and the clamping ring 34. The support ring 40 extends over the entire periphery, radially outside the through holes 22 and 36, and is preferably welded to the ring flange 20 or to the clamping ring 34.

Figure 9A:
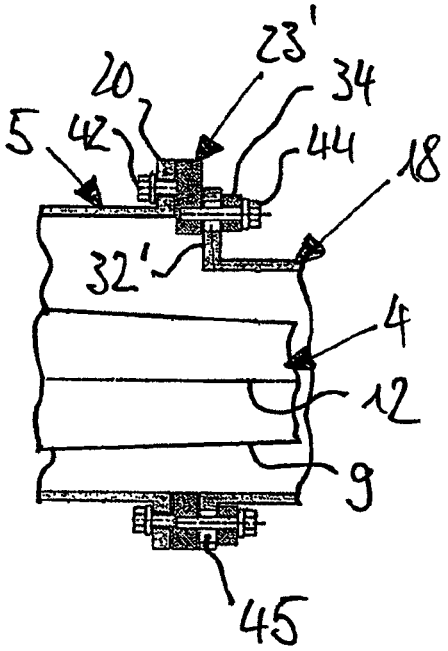
FIGS. 9*a-d* show sections, each in a longitudinal section.

Further embodiments of the invention are explained with respect to FIGS. 9*a* through 9*d*; FIG. 9*a* relates to a simplified embodiment. The cavity pipe 5 together with the ring flange 20 illustrated in FIG. 9*a* corresponds to that described with reference to FIGS. 1 through 8. The adapter ring 23' is formed by a planar annular disc whose outer periphery extends concentrically with respect to the inner periphery. A first hole circle having a series of threaded holes whose hole pattern corresponds to the hole pattern of the through holes 22 in the ring flange 20 is likewise provided concentrically with respect to the outer periphery. A second hole circle having a smaller diameter extends eccentrically with respect to the first hole circle and concentrically with respect to the inner periphery of the adapter ring 23', and has a hole pattern that corresponds to the hole pattern of the through holes 36 in the clamping ring 34. By means of the screws 42 associated with the first hole circle, the adapter ring 23' is screwed to the ring flange 20 in such a way that the partial eccentricity $E_1$ points in the predetermined direction. The setting of the eccentricity $E_1$ by rotating the adapter ring 23' is possible only in a stepped manner in the peripheral spacing of the through holes 22.

By means of the screws 44 associated with the second hole circle, the threaded holes of the second hole circle are used to connect the supporting element 18, which with its eccentric flange 32' is screwed to the adapter ring 23' from the opposite side via the through holes 45. Here as well, setting of the partial eccentricity $E_2$ by rotating about the longitudinal axis is possible only in a stepped manner in the grid of the peripheral spacing of the threaded holes of the second hole circle.

Figure 9B:
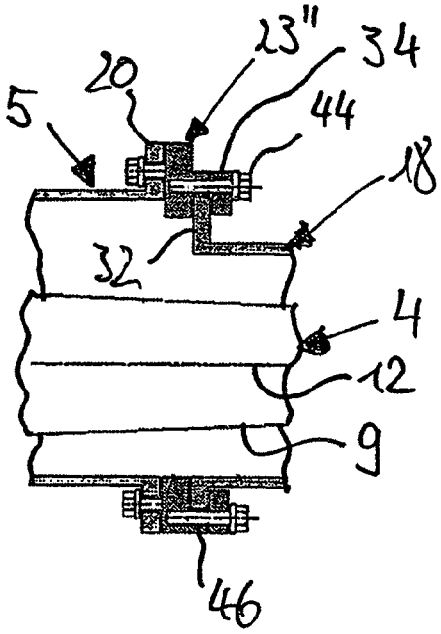

FIG. 9*b* shows a first refinement of the embodiment illustrated in FIG. 9*a*, in which the supporting element 18 is adjustable to the partial eccentricity $E_2$ in a stepless manner. The cavity pipe 5 and the connection of the adapter ring 23" to the cavity pipe 5 correspond to that described with reference to FIG. 9*a*.

The embodiment according to FIG. 9*b* differs from that described in FIG. 9*a* in that the second hole circle in the adapter ring 23" has a larger diameter than the outer periphery of the eccentric flange 32 which is to be axially connected. The screws 44 thus lie radially outside the eccentric flange 32, and via the clamping ring 34 exert a clamping force only in the outermost edge area of the eccentric flange 32. The screws 44 do not hinder the rotation of the supporting element 18 about its longitudinal axis, so that it is possible to rotate the supporting element relative to the adapter ring 23" in a stepless manner.

To optimally prevent bending stresses in the screws 44 and in the clamping ring 34, a spacer ring 46 through which the screws 44 pass is situated between the adapter ring 23" and the clamping ring 34. The spacer ring 46 may be loosely inserted between the adapter ring 23" and the clamping ring 34, or may be integrally molded to the adapter ring 23" or clamping ring 34 as a ring shoulder.

Figure 9C:
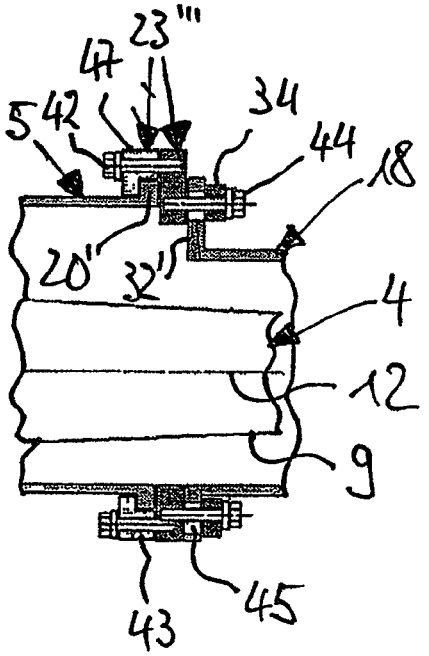

The embodiment according to the invention according to FIG. 9*c* allows the partial eccentricity $E_1$ to be set in a stepless manner. To this end, the outer periphery of the adapter ring 23''' protrudes radially beyond the outer periphery of the ring flange 20'. A clamping flange 47 is clamped against the adapter ring 23''' by means of the screws 42, and engages behind the ring flange 20'. Here as well, a spacer ring 43 through which the screws 42 pass may be situated between the adapter ring 23''' and the clamping flange 47, the spacer ring being loosely inserted between the two parts, or integrally molded to the clamping flange 47 or the adapter ring 23''' as a ring shoulder. The rest of the structural design of the connection of the supporting element 18 to the adapter ring 23''' corresponds to that described with reference to FIG. 9*a*.

Figure 9D:
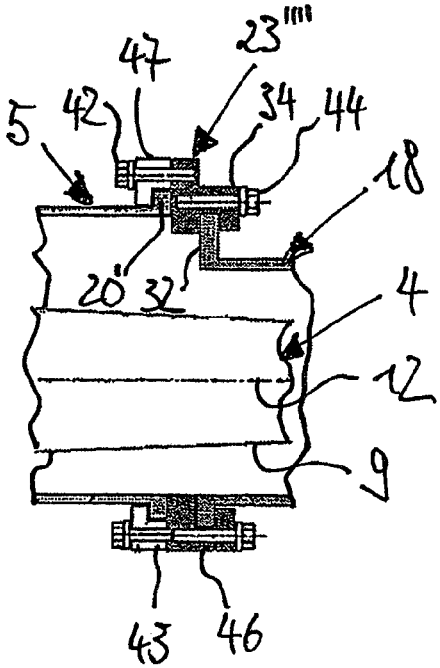

The embodiment shown in FIG. 9*d* corresponds to a combination of the embodiments illustrated in FIGS. 9*b* and 9*c*, which due to a clamping fastening of the adapter ring 23'''' to the ring flange 20' of the cavity pipe 5 and to the eccentric flange 32 of the supporting element 18 allows the partial eccentricity $E_1$ as well as the partial eccentricity $E_2$ to be set in a stepless manner.

It is understood that the invention is not limited to the feature combinations of the individual exemplary embodiments, and also includes combinations of the features of different embodiments.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An arrangement for supporting a tension member transversely with respect to a longitudinal extent thereof in a vicinity of an anchorage of a structure, the arrangement comprising:

a cavity pipe adapted to accommodate the tension member in the vicinity of the anchorage and which extends coaxially along a first longitudinal axis, one end of the cavity pipe terminating in a ring flange, the ring flange having a first axially loadable bearing surface that is concentric with respect to the first longitudinal axis;

an adapter ring, which on its first side facing the cavity pipe has a first axially loadable support surface extending concentrically with respect to the first longitudinal axis and adapted for mounting the adapter ring in a predetermined position on the first bearing surface of the cavity pipe after rotation about the first longitudinal axis, and which on its second side facing away from the cavity pipe has a second axially loadable bearing surface that extends concentrically with respect to a second longitudinal axis and has a first eccentricity with respect to the first longitudinal axis;

a tubular or annular supporting element that has a second axially loadable support surface arranged concentrically with respect to the second axially loadable bearing surface of the adapter ring, and whose opening, which encircles a third longitudinal axis with its inner circumference, forms a supporting surface for the tension member, the opening having a second eccentricity with respect to the second axially loadable support surface of the supporting element; and a fastener adapted to clamp the cavity pipe, the adapter ring, and the supporting element together axially in position relative to one another.

2. The arrangement according to claim 1, wherein a magnitude of the first eccentricity is less than or equal to the magnitude of the second eccentricity.

3. The arrangement according to claim 1, wherein the adapter ring has a first radially loadable bearing surface on its first side which cooperates in a positive-fit manner with a radially loadable surface or an inner periphery of the cavity pipe.

4. The arrangement according to claim 1, wherein the adapter ring has a second radially loadable bearing surface on its second side which cooperates in a positive-fit manner with a radially loadable surface on the supporting element.

5. The arrangement according to claim 1, wherein the adapter ring has an annular recess on its first and/or second side, and the first axially loadable support surface and/or the second axially loadable bearing surface is/are formed by two partial surfaces having an axial offset.

6. The arrangement according to claim 5, wherein the surface of the recess forming the axial offset in each case forms the radially loadable bearing surface.

7. The arrangement according to claim 1, wherein the contact surfaces between the cavity pipe and the adapter ring and/or between the adapter ring and the supporting element have a slip-resistant design, at least in part.

8. The arrangement according to claim 1, wherein the fastener includes at least one clamping ring which is clamped against the ring flange of the cavity pipe via clamping bolts for clamping the adapter ring and the supporting element.

9. The arrangement according to claim 1, wherein a spacer ring which bridges the axial distance is situated between the fastener and the cavity pipe.

10. The arrangement according to claim 1, wherein the adapter ring and/or the supporting element and/or the fastener has/have a multi-part, preferably a two-part, design.

11. The arrangement according to claim 1, wherein the tension member is a stay cable or a prestressing member.

* * * * *